US011498009B2

(12) United States Patent
Johnson

(10) Patent No.: US 11,498,009 B2
(45) Date of Patent: Nov. 15, 2022

(54) TAMPER-RESISTANT WATER DISTRIBUTION SYSTEM AND DEVICES FOR WATERPARK

(71) Applicant: Connelly Skis, LLC, Lynnwood, WA (US)

(72) Inventor: David C. Johnson, White Salmon, WA (US)

(73) Assignee: Connelly Skis, LLC, Lynnwood, WA (US)

( * ) Notice: Subject to any disclaimer, the term of this patent is extended or adjusted under 35 U.S.C. 154(b) by 239 days.

(21) Appl. No.: 16/616,247

(22) PCT Filed: May 30, 2018

(86) PCT No.: PCT/US2018/035159
§ 371 (c)(1),
(2) Date: Nov. 22, 2019

(87) PCT Pub. No.: WO2018/222733
PCT Pub. Date: Dec. 6, 2018

(65) Prior Publication Data

US 2020/0114270 A1 Apr. 16, 2020

Related U.S. Application Data

(60) Provisional application No. 62/512,708, filed on May 30, 2017.

(51) Int. Cl.
*A63G 31/00* (2006.01)
*B05B 15/62* (2018.01)
(Continued)

(52) U.S. Cl.
CPC ..... *A63G 31/007* (2013.01); *A63G 31/12* (2013.01); *B05B 15/62* (2018.02); *B05B 15/65* (2018.02)

(58) Field of Classification Search
CPC ..... A63G 31/007; A63G 31/12; B05B 15/62; B05B 15/65
(Continued)

(56) References Cited

U.S. PATENT DOCUMENTS 2,610,089 A 9/1952 Unger
6,223,673 B1 5/2001 Mears et al.
(Continued)

OTHER PUBLICATIONS

International Search Report and Written Opinion dated Aug. 3, 2018, International Application No. PCT/US2018/035159, International Filing Date May 30, 2018.
(Continued)

*Primary Examiner* — Steven J Ganey
(74) *Attorney, Agent, or Firm* — Perkins Coie LLP

(57) ABSTRACT

A system for waterparks or other uses wherein the system combines an electric pump system that can draw water from a lake, a pool or the sea, and pump it through a hose system and sprinklers that can wet objects on or in the water such as a waterpark. It can be connected to floating platforms or other structures that can elevate the sprinklers off the water. The system features an inflatable platform that has an inflatable tower that allows a hose to extend from underwater, through the center of the tower, to a spray nozzle atop the tower that sprays water in any direction. The system can also be attached to any other waterpark structure with various fittings. This will allow a slow drip of water on some items so as to keep them slippery and wet.

22 Claims, 4 Drawing Sheets

(51) Int. Cl.
*B05B 15/65* (2018.01)
*A63G 31/12* (2006.01)

(58) Field of Classification Search
USPC ..... 239/16, 273, 275, 276, 279, 289, 536, 239/548, 550, 600; 472/116, 128; 62/259.1
See application file for complete search history.

(56) References Cited

U.S. PATENT DOCUMENTS

| | | | | |
|---|---|---|---|---|
| 6,261,186 | B1 * | 7/2001 | Henry | A63G 1/12 239/16 |
| 7,785,207 | B2 * | 8/2010 | Henry | A01G 23/043 472/128 |
| 8,821,304 | B2 | 9/2014 | Ensing | |
| 2003/0073505 | A1 | 4/2003 | Tracy | |
| 2004/0045491 | A1 | 3/2004 | Mele | |
| 2007/0087852 | A1 | 4/2007 | Henry et al. | |
| 2007/0167246 | A1 | 7/2007 | McKee et al. | |
| 2009/0029785 | A1 | 1/2009 | McKee et al. | |
| 2012/0028724 | A1 | 2/2012 | Ensing | |
| 2016/0016084 | A1 * | 1/2016 | Kette | A63G 31/007 472/128 |
| 2016/0136528 | A1 | 5/2016 | Sgromo et al. | |

OTHER PUBLICATIONS

Extended European Search Report dated Dec. 18, 2020, issued in corresponding European Application No. EP18809127.6, filed May 30, 2018, 6 pages.

* cited by examiner

TAMPER-RESISTANT WATER DISTRIBUTION SYSTEM AND DEVICES FOR WATERPARK

RELATED APPLICATION

This application is a 371 filing of international patent application No. PCT/US2018/035159, filed May 30, 2018, which claims the benefit of U.S. Provisional Patent Application Ser. No. 62/512,708, filed May 30, 2017, the contents of which are herein incorporated by reference in their entirety.

TECHNICAL FIELD

The field of the present disclosure relates to inflatable structures for waterparks, aquatic recreation areas, or the like and, in particular, to techniques for wetting and cooling outer surfaces of such inflatable structures.

BACKGROUND INFORMATION

Throughout the world, inflatable waterparks are growing in popularity. The inflatable structures deployed in such waterparks are typically constructed of flexible polyvinyl chloride (PVC) material.

SUMMARY OF THE DISCLOSURE

Disclosed is a tamper-resistant water distribution tower to wet recreation surfaces for patrons. In some embodiments, the tower has a substantially flat platform section having an upper surface; a tower section extending upward from the substantially flat platform section, the tower section having a top, a bottom, and an internal aperture extending along a length between the top and the bottom; and a water supply passageway extending to a water emitter maintained at the top of the tower section, the water supply passageway located within the internal aperture so as to deny the patrons access to at least a portion of the water supply passageway.

In another embodiment of the tower, the water supply passageway comprises a hose.

In another embodiment of the tower, the length of the tower section exceeds a reach distance of those standing on the upper surface of the substantially flat platform section.

In another embodiment of the tower, the tower section includes sidewalls sloped to inhibit climbing.

In another embodiment of the tower, the tower section is wider at the bottom than it is at the top such that a distance along a sidewall of the tower section is longer than a height between the upper surface of the substantially flat platform section and the top of the tower section.

In another embodiment of the tower, the tower section is generally conical in its shape.

In another embodiment of the tower, the bottom of the tower section is fastened to the substantially flat platform section.

In another embodiment of the tower, the water emitter includes a sprinkler head configured to spray water.

In another embodiment of the tower, the sprinkler head is rotatable to change a direction of the spray.

In another embodiment of the tower, the sprinkler head is rotatable about an axis defined by the internal aperture.

In another embodiment of the tower, the substantially flat platform section has a width in a direction perpendicular to the length of the tower section, and in which the width is sized to stabilize the tower section so as to inhibit those standing on the upper surface from tipping over the tamper-resistant water distribution tower.

In another embodiment of the tower, an outer perimeter of the substantially flat platform section includes one or more couplers for attaching the tamper-resistant water distribution tower to one or more adjacent modules of a waterpark.

In another embodiment of the tower, the tower also has the water emitter for delivering, onto at least some recreation surfaces, water pumped from a waterbody on which one or more inflatable components.

In another embodiment of the tower, the tower section is sized so that the water emitter is located out of reach by and inaccessible to those standing on the upper surface of the substantially flat platform section.

In another embodiment of the tower, the tower also has one or more inflatable chambers defining the internal aperture.

In another embodiment of the tower, the tower also has a spray nozzle acting as the water emitter and accessible to the patrons such that they may direct spray of water onto at least some of the recreation surfaces; a hose in fluid communication with the spray nozzle, the hose configured to carry the water; and a retaining device coupled to the spray nozzle or the hose so as to inhibit the patrons from pulling the hose out from the internal aperture beyond a predetermined amount.

In another embodiment of the tower, the retaining device includes a flat retaining plate having a central aperture sized to allow the hose to couple with the spray nozzle.

In another embodiment of the tower, the hose includes a collar having a diameter that is larger than that of the central aperture.

In another embodiment of the tower, the retaining device includes a lock for removing the retaining device from the tower section.

In another embodiment of the tower, the tower is included in a tamper-resistant water distribution system for wetting, with water pumped from a waterbody, one or more inflatable components floating on the waterbody and providing recreation surfaces for the patrons of a waterpark, the tamper-resistant water distribution system comprising a pump for pumping the water through the water supply passageway and out from the water emitter for delivering the water onto at least some of the recreation surfaces.

In another embodiment of the system, the system also has a hose for carrying the water from the pump to the water emitter.

In another embodiment of the system, the pump is in fluid communication with multiple inflatable components of the one or more inflatable components.

In another embodiment of the system, the system also has a hose system including a connector having an input end and a pair of output ends, the input end coupled to receive at least a portion of the water pumped from the waterbody, a first end of the pair of output ends coupled to a first hose for providing to the tower a first portion of the at least the portion of the water pumped from the waterbody, and a second end of the pair of output ends coupled to a second hose for providing to at least one of the one or more inflatable components floating on the waterbody a second portion of the at least the portion of the water pumped from the waterbody.

Additional aspects and advantages will be apparent from the following detailed description of embodiments, which proceeds with reference to the accompanying drawings.

DETAILED DESCRIPTION OF EMBODIMENTS

Surfaces of inflatable structures (i.e., the PVC surfaces) can become rather hot to the touch when exposed to intense sunlight. Hot surfaces are difficult for people to stand and relax on. Dry surfaces are difficult to slide on because they have a higher coefficient of friction, which results in increased wear and tear on the surface from users. Thus, hot and dry surfaces detract from customers' use and enjoyment of a waterpark as excessive surface temperatures make inflatable structures uncomfortable or otherwise less enjoyable for the people attempting to use the structures.

By wetting exposed surfaces of a waterpark, patrons (also referred to as users or customers) may readily slide on wetted park features and they do not become burned by hot surface regions that would otherwise potentially bake under the hot sun. Through evaporative and conductive cooling, wetting exposed surfaces also allows operators to maintain surfaces at lower temperatures, which prolongs their longevity by, for example, reducing friction so as to diminish wear and enhance durability.

A conventional sprinkler system for wetting and cooling the surfaces, however, is challenging to maintain in a waterpark. For example, users improperly or impermissibly grab and take down sprinkler components so as to spray others. The users may then neglect to return the sprinkler components to their intended position.

Figure 1:
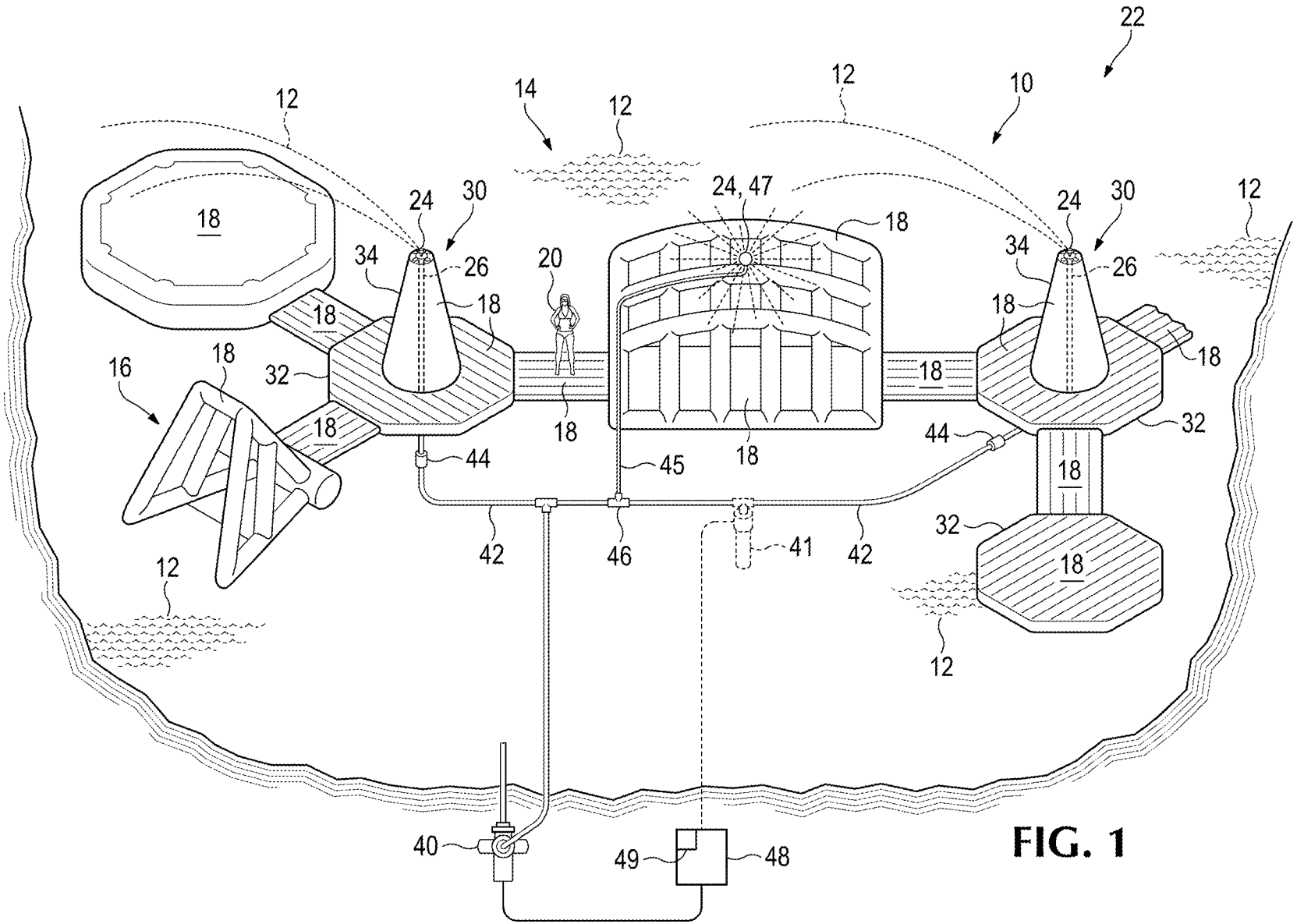
FIG. 1 is an isometric view of a portion of a waterpark.

FIG. 1 shows a tamper-resistant water distribution system 10 for wetting, with water 12 pumped from a waterbody 14, one or more inflatable components 16 floating on waterbody 14 and providing recreation surfaces 18 for patrons 20 of a waterpark 22. In this example, waterbody 14 may be a freshwater or saltwater body. And waterpark 22 may include a cable park or other attractions. In the example of FIG. 1, the attractions that are included among inflatable components 16 include a trampoline module, a swing set module, a swim platform module (see, e.g., U.S. patent application Ser. No. 29/598,710, filed Mar. 28, 2017), a climbing tower module, walkway modules, and tower modules described in later paragraphs.

Tamper-resistant water distribution system 10 includes a water emitter 24 for delivering water 12 onto at least some of recreation surfaces 18. According to some embodiments, water emitter 24 is saltwater resistant and constructed of commercial-grade materials. An example water emitter 24 is an R2000WF/LP Rotator sprinkler head available from Nelson Irrigation Corporation of Walla Walla, Wash. Other water emitters such as misters, drippers, or the like are also possible. For example, a sprinkler head may include an impact sprinkler head, mister, or, more generally, any type of water emitter, including drip systems.

Tamper-resistant water distribution system 10 includes a water supply passageway 26 in fluid communication with water emitter 24. Water supply passageway 26 is configured to carry water 12 (lake water, pool water, or seawater) from waterbody 14 for delivery by water emitter 24 onto at least some of recreation surfaces 18. According to one embodiment, water supply passageway 26 is a section of hose described later with respect to FIG. 3. In another embodiment, water supply passageway 26 is a chamber (e.g., an internal aperture) defined by internal sidewalls described later with respect to FIG. 5.

Also included in tamper-resistant water distribution system 10 is a tam per-resistant water distribution tower 30 (or simply tower 30, of which two are shown in FIG. 1). Tower 30 has two main sections that may be a unitary construction or discrete components attached together during assembly. A first main section is a substantially flat platform section 32. A second main section is a tower section 34 that extends upward from substantially flat upper platform section 32. Using structures to elevate a sprinkler system off water 12 facilitates a sprinkler's ability to spray water 12 in any direction (e.g., about a rotational axis, as shown in FIG. 1).

Figure 2:
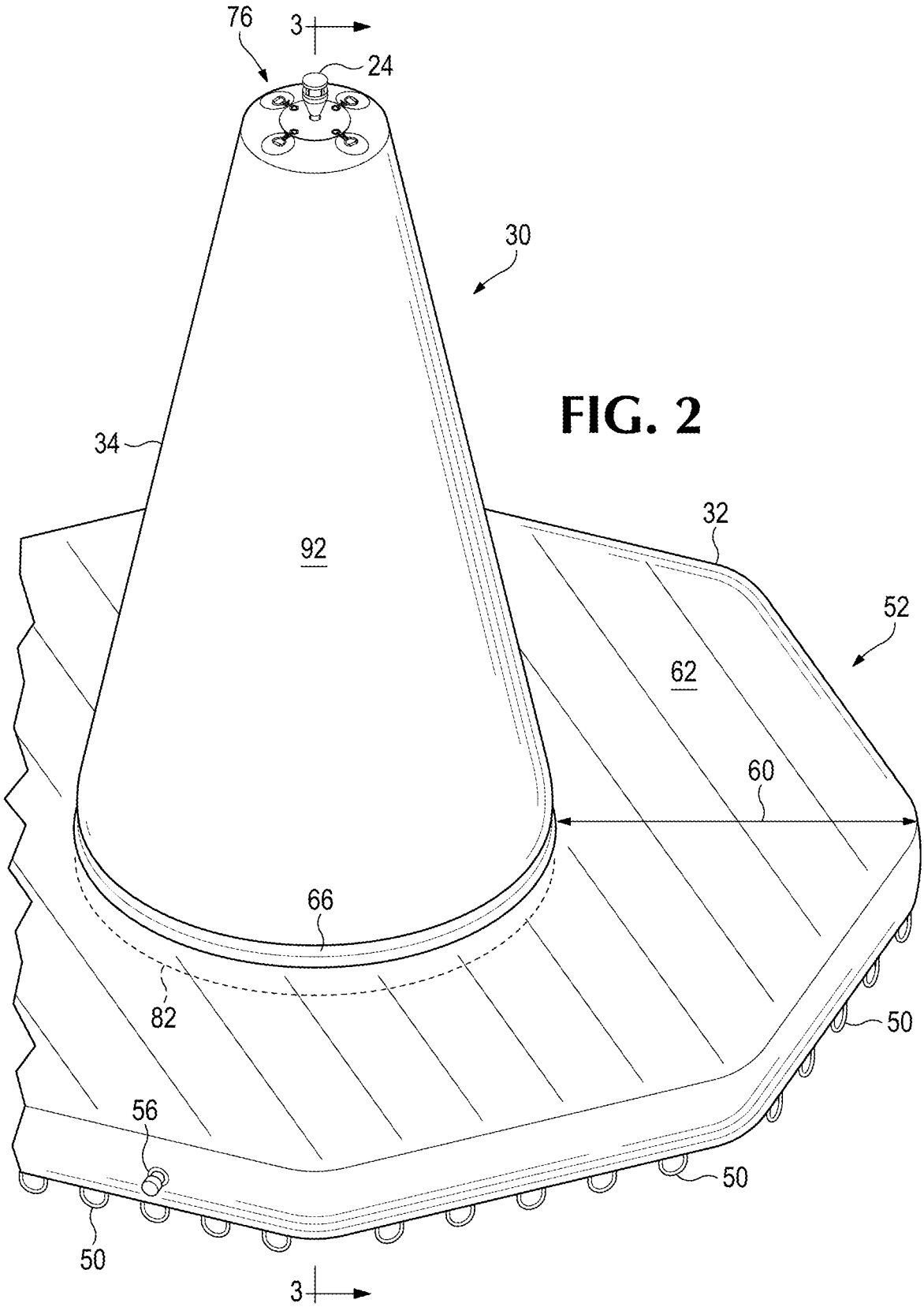
FIG. 2 is an isometric view of a fragment of a tower shown in FIG. 1.
Figure 3:
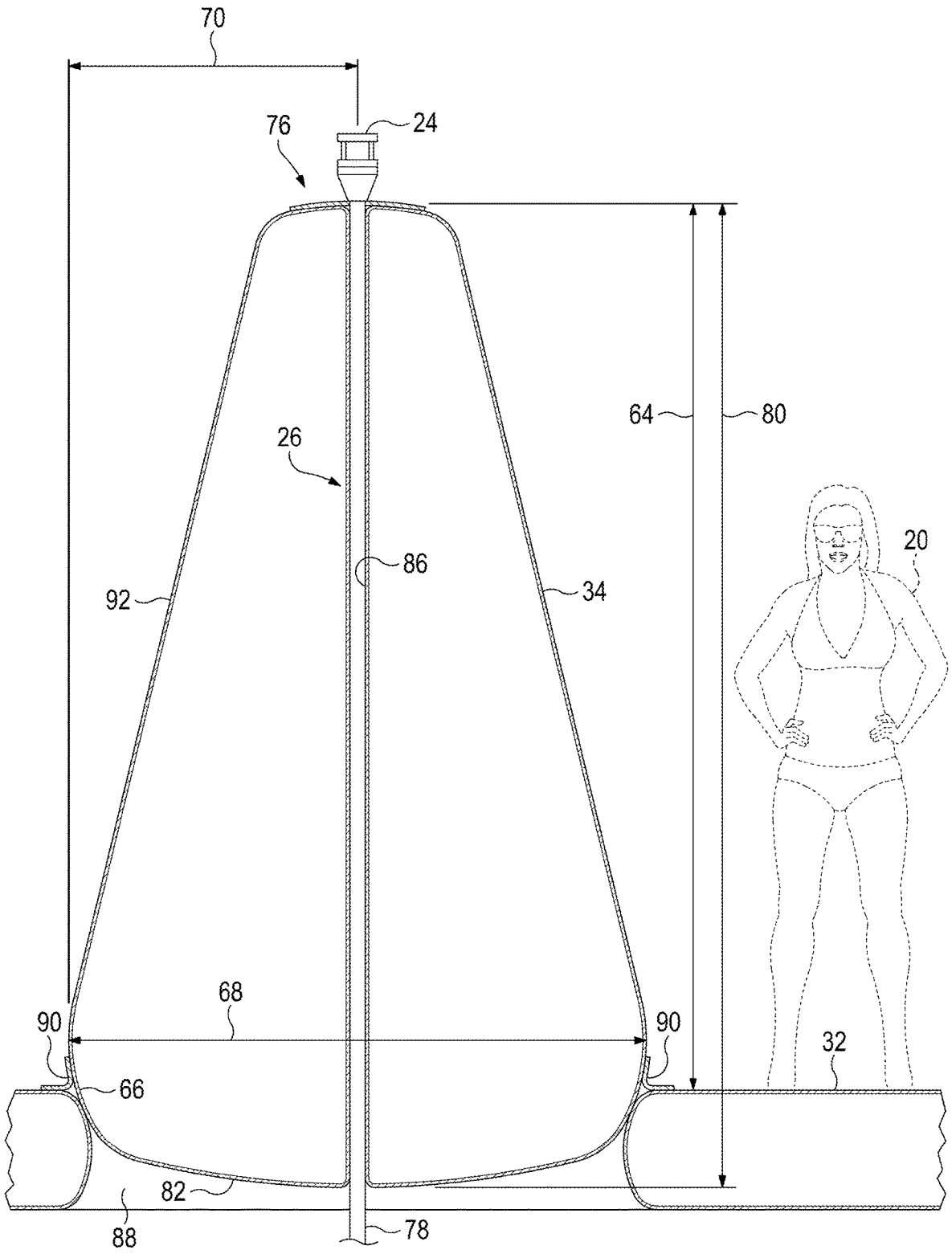
FIG. 3 is a section view taken along line 3-3 of FIG. 2.

Tower 30 may be deployed as a freestanding feature for swimmers to use in waterpark 22 (see, e.g., FIG. 3). In another embodiment, a tower (and its platform) is relatively small and used to spray other surrounding structures sitting on land or floating in water. Thus, a relatively small tamper-resistant water distribution system could also be deployed in pools or even on land as a temporary splash pad. Tower 30 is described in more detail with reference to FIGS. 2-5.

To moisturize recreation surfaces 18, tamper-resistant water distribution system 10 includes an electric pump 40 (or, in another embodiment, a submersible pump 41), a flexible hose system 42 optionally extending underwater, and optional valves 44. Pump 40 draws in water 12 for pumping it through hose system 42 that is in fluid communication with water emitter 24 (i.e., via open valve 44) elevated above a top surface of water 12 for wetting (e.g., spraying or misting) and thereby cooling heat-retaining surfaces of objects afloat in or deployed on land nearby waterbody 14 providing the source of pumped water 12. In other embodiments, hoses carry water 12 from nearby land (i.e., municipal) sources. Hose system 42 and optional valves 44 may be readily assembled underwater and reconfigured to other waterpark structures equipped with water emitters.

An example of pump 40 is an end suction centrifugal pump, such one of the TH series pumps available from EBARA Fluid Handling of Rock Hill, S.C. This type of pump can be deployed on land and fitted with a foot valve in waterbody 14 to suck water 12 and pump it through hose system 42.

An example of submersible pump 41 is a 5 Inch Multistage Bottom Suction Submersible Pump (MXS204S11) available from Munro Companies of Grand Junction, Colo. This type of pump is a high-head multistage submersible pump designed for turf irrigation service, high head dewatering applications, and high pressure, low gallonage water feature projects that expect high head and low flow (i.e., fountains). The pump is made from stainless steel components, outside and inside, which are non-corrosive and built to industrial specifications. All hydraulic parts, including impellers and hydraulic bowl chambers, are made from high-grade stainless steel. The pump also uses the pumped liquid to cool the motor, and the water passing over the motor dampens the noise.

Hose system 42, which may include any type of hoses, is at least partly submerged, e.g., not buoyant or anchored, so that it does not obstruct swimmers. Examples of products suitable for underwater hose system 42 and optional valves 44 are Blu-Lock connections and tubing available from HydroRain of North Salt Lake, Utah. Also, hose system 42 may be customized by adding additional water delivery lines and couplers, such as hose 45 connected at T-connection junction 46, so as to wet other objects (e.g., the climbing structure) with spray, drip, mist, fountain, or other type of nozzle 47. And skilled persons will appreciate that hose 45 may be the same or different diameter than hoses of hose system 42. Such T-connections and smaller hoses may be placed at various locations and run up sides of items to provide drip type water distribution on, e.g., larger slides and towers. Other hoses can be attached to adapt to any park layout and desired spray coverage from a single pump.

An electric power supply 48 located on land supplies power to pump 40. A timer 49 controls periods in which power is supplied to or disconnected from pump 40. In another embodiment, timer 49, or other controller, allows pump 40 to be switched on or off from land using an electrically controlled valve or electric switch that controls water flow through pump(s). In other embodiments, valves 44 or other components are temporally controlled. By placing tamper-resistant water distribution system 10 under an optional temporal control system, periodic or random spraying makes waterpark 22 more exciting to swimmers because the intermittent or spontaneous activation of sprinklers comes as a surprise.

FIG. 2 shows tower 30 having d-rings 50 (i.e., a type of coupler) attached to an outer portion of an eight-sided (octagon shaped) perimeter 52 of flat platform section 32. D-rings 50 are used to attach any side of octagon-shaped perimeter 52 to another module (as shown in FIG. 1). Thus, various floating components of tamper-resistant water distribution system 10 are moveable to and attachable with any other waterpark structures, buoyant or otherwise, by use of fasteners that retain components in proximity to other structures.

An inflation valve 56 is also provided in perimeter 52. According to some embodiments, one or both of flat platform section 32 and tower section 34 are a unitary chamber inflatable through inflation valve 56. In another embodiment, flat platform section 32 and tower section 34 are separate chambers in which case a second inflation valve (not shown) may be included for tower section 34. In other embodiments, tower section 34, flat platform section 32, or both are not inflatable but instead constructed of generally solid (except for a small central aperture through which water passes) polystyrene, foam, plastic, any other solid buoyant material, or combinations of solid or rigid materials.

FIG. 2 also shows that tower section 34 is centrally located with respect to perimeter 52. Moreover, flat platform section 32 has a fairly wide 60 upper surface 62 to accommodate patrons standing or sitting on upper surface 62. Width 60 (about 140 cm) and the central location of tower section 34 enhance the stability of tower 30 so that a patron standing or even jumping at an outer edge (near perimeter 52) cannot readily tip tower 30 over as it floats atop water 12. A height of perimeter 52 (about 50 cm, e.g., when inflated) also provides stability. Skilled persons will appreciate, however, that exact desired dimensions, buoyancy considerations, and other implementation details may vary.

In terms of tamper-resistance, FIG. 3 shows that tower section 34 is sized so that water emitter 24 is elevated out of reach by and inaccessible to those standing on upper surface 62 (FIG. 2) of substantially flat platform section 32. Sloped sidewalls inhibit patrons from climbing tower section 34 to reach water emitter 24. Also, a tall conical shape of tower section 34 inhibits patrons from simply reaching up to grab water emitter 24, which is about eight feet (250 cm) in height 64 measured from a base 66 of tower section 34. Height 64 is chosen to be any distance at which most patrons would find difficult to reach. In addition, base 66 has a relatively wide width 68 (about 150 cm) and water emitter 24 is recessed relative to width 68 such that patrons would also need to reach upward and over some lateral distance 70 of about 75 cm to reach water emitter 24 at a top 76 (about 40 cm wide) of tower 30. Reaching upward and over (i.e., along a hypotenuse angle, for example) extends beyond eight-foot height 64 a total distance needed to reach water emitter 24. In some embodiments, a cylindrical tower section, an inverted cone, octagonal pyramid, or other shapes may be used to achieve a similar tamper-resistant distance for the location of water emitter 24.

FIG. 3 also shows another tamper-resistant feature. Specifically, FIG. 3 shows a central hose 78 (e.g., of hose system 42) extending along a length 80 from a bottom 82 of tower section 34, through an internal aperture 86 of tower section 34, to top 76 where central hose 78 is coupled to water emitter 24 for spraying in any direction water 12 pumped up central hose 78. In other words, central hose 78 is shielded within tower section 34 so that patrons 20 are denied access to the water supply and cannot attempt to disconnect any length of central hose 78 that might otherwise be readily accessible. Central hose (or pipe) 78 may be directly or indirectly connected to pump 40.

Finally, FIG. 3 shows that bottom 82 of tower section 34 fits in a wide central aperture 88 of flat platform section 32. Central aperture 88 has a width (about 100 cm) that is slightly narrower than width 68 so that tower section 34 (e.g., when inflated) does not slip through central aperture 88. A strip of material 90 and adhesive bond upper surface 62 of flat platform section 32 (FIG. 2) and outer surface 92 of tower section 34.

Figure 4:
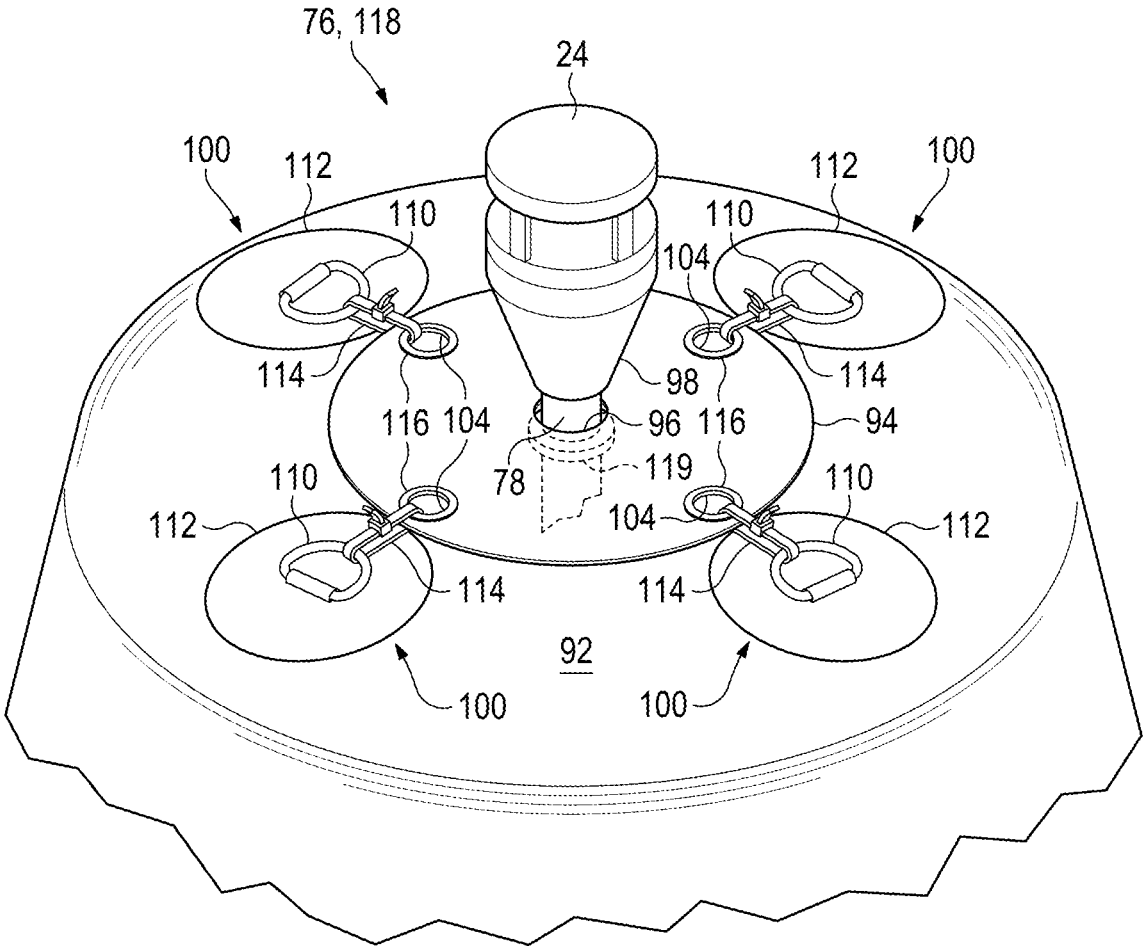
FIG. 4 is an enlarged isometric view of a fragment of a top of the tower shown in FIGS. 1 and 2.

FIG. 4 shows an example for mounting water emitter 24 at top 76 of tower section 34. A flat mounting plate 94 (which may be wood, plastic, PVC material, rigid, or flexible) has a central aperture 96 sized to permit central hose 78 to be passed through aperture 96, but sufficiently small to block a bottom 98 of water emitter 24 from slipping back through aperture 96. Flat mounting plate 94 is then secured to top 76 of tower section 34 by four anchor points 100 that are mutually angularly spaced apart by 90 degrees. Each anchor point 100 includes a perimeter aperture 104 on flat mounting plate 94, a d-ring 110 that is looped through a portion of an anchor patch 112 adhered to outer surface 92, and a zip tie 114 (or straps or hook-and-loop fastener) fastening d-ring 110 to aperture 104. A metal grommet 116 reinforces aperture 104. In other embodiments, a sprinkler hose or pipe is passed through internal aperture 86 of tower section 34 and a sprinkler is held at top 76 without additional support.

Skilled persons will appreciate that various other tamper-resistant features, alone or in combination with the previously described features, may be incorporated into the design of tower 30, depending on its desired height and the desire to allow patrons an ability to access water emitter 24 and optionally an upper portion of hose 78. For example, tower section 34 could be shorter—e.g., about four feet (120 cm) or less in height—in which case patrons could simply stand on upper surface 62 (FIG. 2) and spray their friends by directing spray from water emitter 24 (e.g., in the form of a squirt gun or other type of spray nozzle). Patrons, therefore, could readily reach water emitter 24, at which point other tamper-resistant features could come into effect. For example, to prevent patrons from readily removing water emitter 24 or pulling it away from flat mounting plate 94, a removable or fixed collar may be placed at a specified length along hose 78 so as to allow a predetermined amount of slack for users to deploy water emitter 24 as they see fit. Thus, FIG. 4 shows a retaining device 118 used to inhibit a patron from pulling water emitter 24 (or hose 78) out from aperture 96. In this embodiment, retaining device 118 includes a removable collar 119 having a diameter that is wider than that of aperture 96. Other types of retaining devices, including devices that are integral or releasably attached to hose 78, are also possible.

In some embodiments, retaining device 118 may include a lockable and unlockable device that itself acts as a tamper-resistant feature. For example, zip ties 114, in some embodiments, are simply substituted with locks. Thus, maintenance personnel may readily remove the locks, pull hose 78 out by some desired amount, e.g., several feet, and then use water emitter 24 to spray down or clean various other surfaces of waterpark 22. Once that maintenance task is complete, hose 78 is then pushed back down into aperture 96 (i.e., retracted, for example), and locks (or a single locking device) are refastened to once again inhibit patrons from pulling out hose 78.

Various mechanical hose retractors or reels may also be included so that, when a user is done spraying friends, hose 78 is automatically retracted to its nominal position shown in FIG. 4. For example, a hose retractor includes a counter-balance weight (e.g., a weighted collar, not shown) mounted to hose 78, e.g., near bottom 82 (FIG. 3). In one embodiment, the weighted collar acts to sink a lower portion of hose 78 downward into waterbody 14, thereby pulling water emitter 24 toward its nominal location atop retaining device 118. This helps address the situation in which a patron sprays some friends and then forgets to return water emitter 24 to its initial location.

Figure 5:
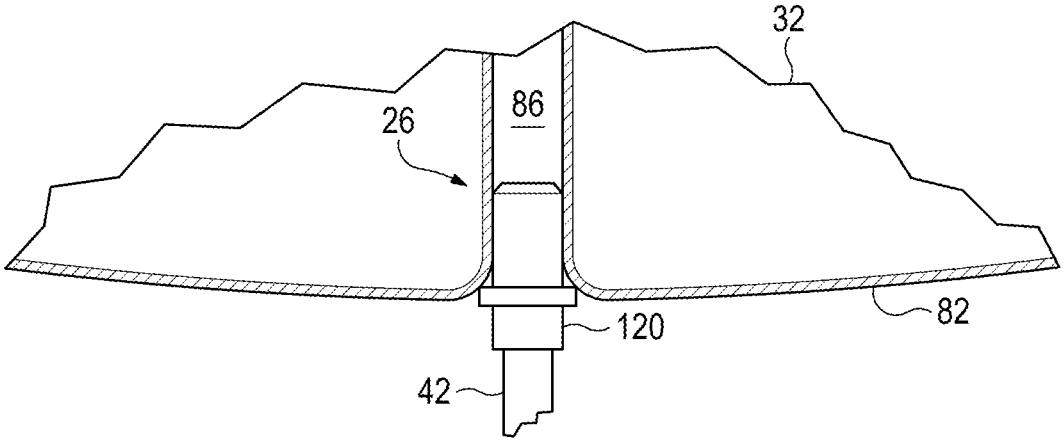
FIG. 5 is an enlarged cross sectional view of a tower having an internal aperture that also acts as a passageway for carrying water.

FIG. 5 shows an embodiment of water supply passageway 26 in which no internal hose is employed. Instead, an adaptor 120 is applied to a water line (e.g., a free end of hose system 42). Water 12 is pumped out of adaptor 120 and directly into internal aperture 86 without a hose. In other words, internal sidewalls act as a hose. A similar adaptor (not shown) is provided at top 76 to receive water 12 and provide it to water emitter 24.

Skilled persons will appreciate that many changes may be made to the details of the above-described embodiments without departing from the underlying principles of the invention. For example, in some embodiments, a pole attached to a central aperture or a peripheral side of a floating platform may be used to elevate the sprinkler in lieu of an inflatable tower. The scope of the present invention should, therefore, be determined only by the following claims.

The invention claimed is:

1. A tamper-resistant water distribution tower to wet recreation surfaces for patrons, comprising:

a substantially flat platform section having an upper surface;

a tower section extending upward from the substantially flat platform section, the tower section having a top, a bottom, and an internal aperture extending along a length between the top and the bottom, wherein the internal aperture is defined by one or more inflatable chambers; and a water supply passageway extending to a water emitter maintained at the top of the tower section, the water supply passageway located within the internal aperture so as to deny the patrons access to at least a portion of the water supply passageway.

2. The tamper-resistant water distribution tower of claim 1, in which the water supply passageway comprises a hose.

3. The tamper-resistant water distribution tower of claim 1, in which the length of the tower section exceeds a reach distance of those standing on the upper surface of the substantially flat platform section.

4. The tamper-resistant water distribution tower of claim 1, in which the tower section includes sidewalls sloped to inhibit climbing.

5. The tamper-resistant water distribution tower of claim 1, in which the tower section is wider at the bottom than it is at the top such that a distance along a sidewall of the tower section is longer than a height between the upper surface of the substantially flat platform section and the top of the tower section.

6. The tamper-resistant water distribution tower of claim 5, in which the tower section is generally conical in its shape.

7. The tamper-resistant water distribution tower of claim 1, in which the bottom of the tower section is fastened to the substantially flat platform section.

8. The tamper-resistant water distribution tower of claim 1, in which the water emitter includes a sprinkler head configured to spray water.

9. The tamper-resistant water distribution tower of claim 8, in which the sprinkler head is rotatable to change a direction of the spray.

10. The tamper-resistant water distribution tower of claim 9, in which the sprinkler head is rotatable about an axis defined by the internal aperture.

11. The tamper-resistant water distribution tower of claim 1, in which the substantially flat platform section has a width in a direction perpendicular to the length of the tower section, and in which the width is sized to stabilize the tower section so as to inhibit those standing on the upper surface from tipping over the tamper-resistant water distribution tower.

12. The tamper-resistant water distribution tower of claim 1, further comprising the water emitter for delivering, onto at least some recreation surfaces, water pumped from a waterbody on which one or more inflatable components.

13. The tamper-resistant water distribution tower of claim 1, in which the tower section is sized so that the water emitter is located out of reach by and inaccessible to those standing on the upper surface of the substantially flat platform section.

14. The tamper-resistant water distribution tower of claim 1 included in a tamper-resistant water distribution system for wetting, with water pumped from a waterbody, one or more inflatable components floating on the waterbody and providing recreation surfaces for the patrons of a waterpark, the tamper-resistant water distribution system comprising a pump for pumping the water through the water supply passageway and out from the water emitter for delivering the water onto at least some of the recreation surfaces.

15. The tamper-resistant water distribution system of claim 14, further comprising a hose for carrying the water from the pump to the water emitter.

16. The tamper-resistant water distribution system of claim 14, in which the pump is in fluid communication with multiple inflatable components of the one or more inflatable components.

17. A tamper-resistant water distribution tower to wet recreation surfaces for patrons, comprising:

a substantially flat platform section having an upper surface, wherein an outer perimeter of the substantially flat platform section includes one or more couplers for attaching the tamper-resistant water distribution tower to one or more adjacent modules of a waterpark;

a tower section extending upward from the substantially flat platform section, the tower section having a top, a bottom, and an internal aperture extending along a length between the top and the bottom;

a water supply passageway extending to a water emitter maintained at the top of the tower section, the water supply passageway located within the internal aperture so as to deny the patrons access to at least a portion of the water supply passageway.

18. A tamper-resistant water distribution tower to wet recreation surfaces for patrons, comprising:

a substantially flat platform section having an upper surface;

a tower section extending upward from the substantially flat platform section, the tower section having a top, a bottom, and an internal aperture extending along a length between the top and the bottom;

a water supply passageway extending to a water emitter maintained at the top of the tower section, the water supply passageway located within the internal aperture so as to deny the patrons access to at least a portion of the water supply passageway;

a spray nozzle acting as the water emitter and accessible to the patrons such that they may direct spray of water onto at least some of the recreation surfaces;

a hose in fluid communication with the spray nozzle, the hose configured to carry the water; and a retaining device coupled to the spray nozzle or the hose so as to inhibit the patrons from pulling the hose out from the internal aperture beyond a predetermined amount.

19. The tamper-resistant water distribution tower of claim 18, in which the retaining device includes a flat retaining plate having a central aperture sized to allow the hose to couple with the spray nozzle.

20. The tamper-resistant water distribution tower of claim 19, in which the hose includes a collar having a diameter that is larger than that of the central aperture.

21. The tamper-resistant water distribution tower of claim 18, in which the retaining device includes a lock for removing the retaining device from the tower section.

22. A tamper-resistant water distribution tower to wet recreation surfaces for patrons, comprising:

a substantially flat platform section having an upper surface;

a tower section extending upward from the substantially flat platform section, the tower section having a top, a bottom, and an internal aperture extending along a length between the top and the bottom;

a water supply passageway extending to a water emitter maintained at the top of the tower section, the water supply passageway located within the internal aperture so as to deny the patrons access to at least a portion of the water supply passageway wherein the tamper-resistant water distribution tower is included in a tamper-resistant water distribution system for wetting, with water pumped from a waterbody, one or more inflatable components floating on the waterbody and providing recreation surfaces for the patrons of a waterpark, the tamper-resistant water distribution system comprising— a pump for pumping the water through the water supply passageway and out from the water emitter for delivering the water onto at least some of the recreation surfaces; and a hose system including a connector having an input end and a pair of output ends, the input end coupled to receive at least a portion of the water pumped from the waterbody, a first end of the pair of output ends coupled to a first hose for providing to the tower a first portion of the at least the portion of the water pumped from the waterbody, and a second end of the pair of output ends coupled to a second hose for providing to at least one of the one or more inflatable components floating on the waterbody a second portion of the at least the portion of the water pumped from the waterbody.

* * * * *